US005289597A

United States Patent [19]

Sidola

[11] Patent Number: 5,289,597

[45] Date of Patent: Mar. 1, 1994

[54] METHOD AND APPARATUS FOR HAIR TREATMENT

[76] Inventor: Leo E. Sidola, 723 Barker Row, Nanty-Glo, Pa. 15943

[21] Appl. No.: 545,495

[22] Filed: Jun. 29, 1990

[51] Int. Cl.[5] ..... A45D 19/08

[52] U.S. Cl. ..... 4/519; 4/520; 4/522; 4/658

[58] Field of Search ..... 4/515, 516, 517, 518, 4/519, 520, 521, 522, 523, 653, 658, 640, 642, 251.1

[56] References Cited

U.S. PATENT DOCUMENTS

| | | | |
|---|---|---|---|
| 79,117 | 6/1868 | Havanagh | 4/658 |
| 1,616,313 | 2/1927 | Farmer | 4/642 |
| 2,035,000 | 3/1936 | Swain | 4/642 |
| 2,172,589 | 9/1939 | Middleton | 4/520 |
| 4,369,532 | 1/1983 | Houchins et al. | 4/658 |

*Primary Examiner*—Henry J. Recla
*Assistant Examiner*—Charles R. Eloshway

[57] ABSTRACT

Disclosed herein is a hair treatment sink assembly and a method of collecting hair treatment materials during treatment operations. Further disclosed is a drip collection tray for collecting hair treatment materials during a hair treatment operation. The sink assembly is comprised of a basin with a drip tray installed beneath it to collect any hair treatment materials falling outside the basin. The method of collecting hair treatment materials during a hair treatment operation comprises the steps of resting a patron's head over a basin, applying hair treatment materials to the patron's head and catching the materials falling from the head in the basin and the materials falling outside the basin in a drip tray installed below the upper rim of the basin. The drip collection tray is comprised of a pan with surrounding side walls and a drain. The pan has portions that extend outside the envelope of the basin, when viewed in plan, on at least two side portions and the front portion of the basin. The method of modifying an already installed basin comprises the steps of locating the drip tray according to the present invention beneath the basin, providing support for said drip tray and joining the drain of the drip tray to the drain line of the basin. Supports for the drip tray are disclosed and comprise brackets that extend from and between the basin walls and the drip tray side walls.

10 Claims, 3 Drawing Sheets

METHOD AND APPARATUS FOR HAIR TREATMENT

FIELD OF INVENTION

The present invention pertains to a method and apparatus for hair treatment and is specifically concerned with a sink assembly and shampoo cape for washing and/or shampooing hair. This invention also contemplates the method of keeping water and other hair treatment materials from dripping onto surrounding floors during hair treatment operations.

BACKGROUND OF THE INVENTION

Professional hair treatment centers such as beauty salons and barber shops conventionally use a basin conventionally called a shampoo bowl on which a patron rests their head and neck so that their hair may be treated. The usual basin or shampoo bowl will have a specially formed region in the form of a concave indentation that is supposed to fit the head or neck portion of a patron so that the patron may rest his head and neck thereon while being treated. This specially formed or indented region is supposed to co-operate with the patron's head and neck area so as to prevent hair treatment materials from falling outside the basin area during a hair treatment operation. The problem with such an arrangement is that the patron may move during the operation and thereby allow water or other hair treatment materials to spill over the rim of the basin and fall to the floor. Additionally, the specially formed region or indentation on the basin that is supposed to prevent such spillage, is usually designed to do so by indenting the special region in a concave fashion so as to provide a form fitting seal between the patron's head or neck area and the special indented region of the basin. The special shaping usually takes the form of a concave indentation rigidly contoured in the upper rim of the basin. The rigidly formed indentation cannot cope with the patron's movements and it does not take into account the fact that most people do not rest their head and necks in the same manner on the shaped region of the rim. Further, the rigid indentations do not take into account that everyone's head and neck areas are formed differently, so that one particular contoured shape that fits one person will not necessarily fit another. Because of this the spillage of hair treatment materials still occurs, and the floors of salons and other hair treatment places still continue to be flooded.

A still further problem with the arrangements of the prior art is the fact that the chairs that fit adjacent to the basins, allowing the patron to rest their head on the basin, leave a gap between the basin and the back of the chair, for spilled hair treatment materials to fall directly to the floor.

Others have addressed this problem, examples of these attempts are exhibited in the following U.S. Pat. Nos. 2,501,829 granted to Rugh; 2,172,589 granted to Middleton; 2,163,755 granted to Labruzzo; 3,731,325 granted to Guarrasi; and 2,013,823 granted to Chancer.

Having spent 49 years in this business, I have come to believe that the problem has not been solved by attacking it in the manner represented by the above attempts.

Non-analogous situations are shown by U.S. Pat. Nos. 79,115 granted to Havanagh; 4,369,532 granted to Houchins et al; and a French patent 1.280.943 to Barry.

SUMMARY OF INVENTION

According to the present invention there is disclosed a hair treatment sink or shampoo bowl assembly which comprises a base portion having lateral walls that completely surround the base portion. The lateral walls extend upwardly from the base portion to an upper peripheral rim formed by the termination of the upwardly extending walls. A head and neck rest is formed in the upper peripheral rim on which a patron having their hair treated may rest portions of their head and neck during the operation. The head and neck rest are in the form of a concave indentation formed in the upper peripheral rim. A drain line is connected to and extends downwardly from the base portion to drain the water and other hair treatment materials contained by the base portion and the lateral walls.

A drip collection tray is located below the upper peripheral rim, with the drip collection tray extending outwardly from at least portions of the front and side lateral walls of the base portion so as to collect material falling from the upper rim, outside of said lateral walls. A drain line extends downwardly through the drip collection tray to drain the collected material.

The drip collection tray comprises a pan, which preferably is comprised of planar portion or planar portions, having a drain extending downwardly through the planar portion or portions. The tray is preferably made of a fiberglass or plastic material and all transitions from one planar portion to another part of the tray should be smoothly rounded for ease of cleaning. Side walls extend upwardly from the pan and preferably completely surround the pan. The side walls and the pan preferably co-operate to direct falling hair treatment material toward the drip pan drain. The pan of the drip tray is positioned so that it extends in a horizontal direction beneath the base portion of the basin of the sink assembly. The drain line of the base portion is preferably joined to the drain line of the drip tray by a joint below both the base portion and the pan.

The drip tray is preferably attached and supported by brackets or other means extending and connecting between the basin and the drip tray. This is preferably accomplished by support brackets connecting between the laternal walls of the base portion and the side walls of the pan.

Further, according to the present invention a shampoo cape is provided which comprises an appropriate waterproof or repellant material and having an opening formed in said material so that the material may surround the patron's neck and fastens on adjacent portions of said opening to hold the shampoo cape in said position around said patron's neck. The shampoo cape further comprises a front part for covering the upper torso of the patron, while the patron is seated and using the shampoo bowl. The shampoo cape further comprises a rear part for extending rearwardly from the patron's neck and shoulder area toward the drip pan located beneath the shampoo bowl.

In the preferred mode of the invention it is contemplated that a patron will be seated in a chair having a reclining or adjustable upright back thereon, with the patron having their back to the front of the hair treatment or shampoo basin. In this manner, it is contemplated that the shampoo cape will be attached around the neck of the patron by overlapping the lateral ends of the shampoo cape and attaching them together by velcro fasteners or locks, already known in the trade, and the rear part of the shampoo cape will extend over the back of the chair, and extend over the front of the drip tray so as to direct hair treatment materials spilling or falling from the basin to the drip collection tray. In order to facilitate this arrangement guide posts are provided on the uppermost lateral edges of the back of the chair. The shampoo cape will be fitted between the posts in such a manner that it will extend downwardly from the back of the chair and over the front of the drip collection tray.

The preferable form of the drip collection tray is a rectangular configuration when viewed in plan with the rectangular tray having width and length dimensions of approximately 13½ inches by 18½ inches. With either one of the above mentioned rectangular configurations the preferred upward extension of the side walls from the pan is on the order of approximately 4 inches.

According to the present invention, the drip tray is comprised of a pan means forming a bottom section with a drain extending downwardly through the pan. Side walls surround the outer periphery of the pan and extending upwardly therefrom, preferably for a distance of approximately four inches. Attachment means is provided on one of the either the pan or the side wall for connection to a basin.

The collection tray according to the present invention preferably comprises a pan having one or more pan portions sloped downwardly and extending from the side said walls to the pan drain. The pan portions are preferably of fiberglass or plastic and are planar in nature, with at least one planar portion sloping toward the pan drain. It is preferred that the material of the pan be fiberglass or plastic so that it is easier to clean and lighter in weight.

Preferably the drip collection tray according to the present invention will have a pan means that when viewed in plan has a rectangular configuration with width and length dimensions of approximately 13½ inches by 18½ inches.

The present invention also contemplates the method of collecting hair treatment materials during a hair treatment operation. The method comprises the steps of providing a head and neck rest on an upper portion of a basin upon which a patron may rest part of their head or neck or parts of both head and neck. A further step is surrounding the outer portion of the basin, when viewed from a plan view, with a drip tray, and locating the drip tray beneath the lowermost part of an upper portion of the basin. A further step is resting a patron's head and/or neck on the head and/or neck rest so that the head is over the basin. A further step is to apply hair treatment materials to the head of the patron and allow any excess materials to fall toward the basin. A further step is collecting any materials that fall outside the basin in the drip tray, and draining said basin and said drip tray either as the materials fall into them or after the hair treatment operation has been completed. The method also contemplates the step of locating an upright back portion chair next to the basin with the back of the chair facing the front of the basin, so that the patron may be seated and rest their head and/or neck on the head and/or neck rest of the basin. Preferably the method also includes the step of extending the shampoo cape between the two guide posts on the upper back side of the chair, the guide posts are preferably 13½ inches apart, and letting it hang freely over the front side of the drip tray so that material falling on the shampoo cape is directed to the drip tray. The method further must include the step of providing guide posts on each lateral side of the upright portion of the chair to control the flow of materials to the drip tray. The method further includes the steps of forming the drip tray of a planar pan portion, and providing a drain extending down through the planar pan portion so as to drain the pan portion either during or after the hair treatment operation.

The method preferably further includes the step of providing the pan portion with surrounding side wall means that extend upwardly from the pan portion so that the pan portion and the side wall means direct material falling on the pan portion to the drain. The method also preferably includes the step of locating the pan portion so that it extends from side wall means to side wall means beneath the basin. The method also preferably includes the step of joining the drain line of the basin with the drain line of the drip tray so as to form a single drain line.

The present invention also contemplates the method of modifying an already installed hair treatment basin which comprises the steps of forming a drip collection tray having a drain and positioning the drip collection tray beneath the basin so that portions of the tray extend outwardly of the front, and portions of the side, peripheral walls of the basin. The method further includes the step of supporting the drip collection tray in position beneath the basin and joining the drain of the drip collection tray to the drain line of the basin. The method further preferably includes the step of supporting the drip collection tray in position beneath the basin by attaching connecting means between the drip collection tray and the basin. The method further preferably includes the step of providing a shampoo cape for guiding hair treatment materials from said patron's head and neck area into said drip tray.

It is an object of the present invention to provide a more suitable device and method for preventing spillage of hair treatment materials on the floor of hair treatment establishments.

It is an object of the present invention to provide a method for modifying present hair treatment basins so as to reduce spillage on the floor of hair treatment establishments.

It is an object of the present invention to reduce the clean up time that may be necessary after a hair treatment operation.

It is a still further object of the present invention to provide a collection device that will prevent spillage of hair treatment materials regardless of the variations in the size of the heads and necks of the various patron's using the device.

It is a still further object of the present invention to provide a device that minimizes spillage without interfering with the operations necessary for the hair treatment of a patron.

It is a still further object of the present invention to provide a system for more efficient collecting and draining of hair treatment materials.

It is a still further object of the present invention to provide a drip tray that may be easily installed with already existing basins.

It is a still further object of the present invention to provide a shampoo cape to extend between a seated patron and a drip tray to prevent spillage of hair treatment materials onto the floor or the salon.

For a more complete understanding of the invention and the objects and advantages thereof, reference should be had to the accompanying drawing and the following detailed description wherein preferred embodiments of the invention are illustrated and described.

DETAILED DESCRIPTION OF THE PREFERRED EMBODIMENTS

Figure 1:
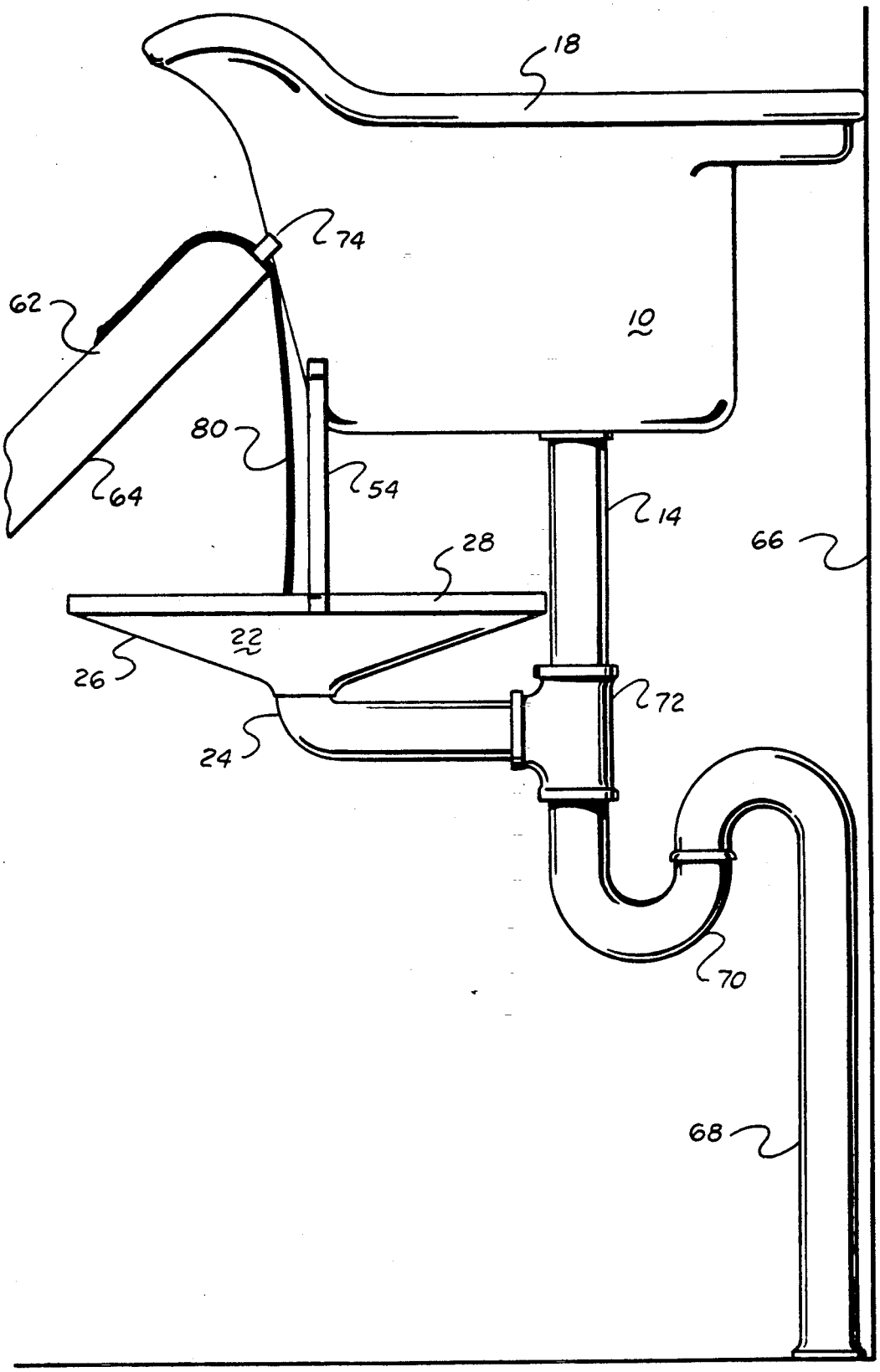
FIG. 1 is a side view arrangement according to the present invention.

What is shown in FIG. 1 is a side view of a drip pan assembly according to the present invention. Shown in FIG. 1 is a basin 10, having a base portion 12. A drain 14 is shown extending down through the base portion 12. Lateral walls 16 are shown in FIG. 1 and completely surrounding the base portion 12. The lateral walls 16 extend upwardly from the base portion 12 and terminate in an upper peripheral rim 18 shown in FIG. 1. A head and/or neck rest 20 is shown contoured in the upper peripheral rim 18 and is designed so that a patron may rest the back of his or her head and/or neck thereon.

Figure 2:
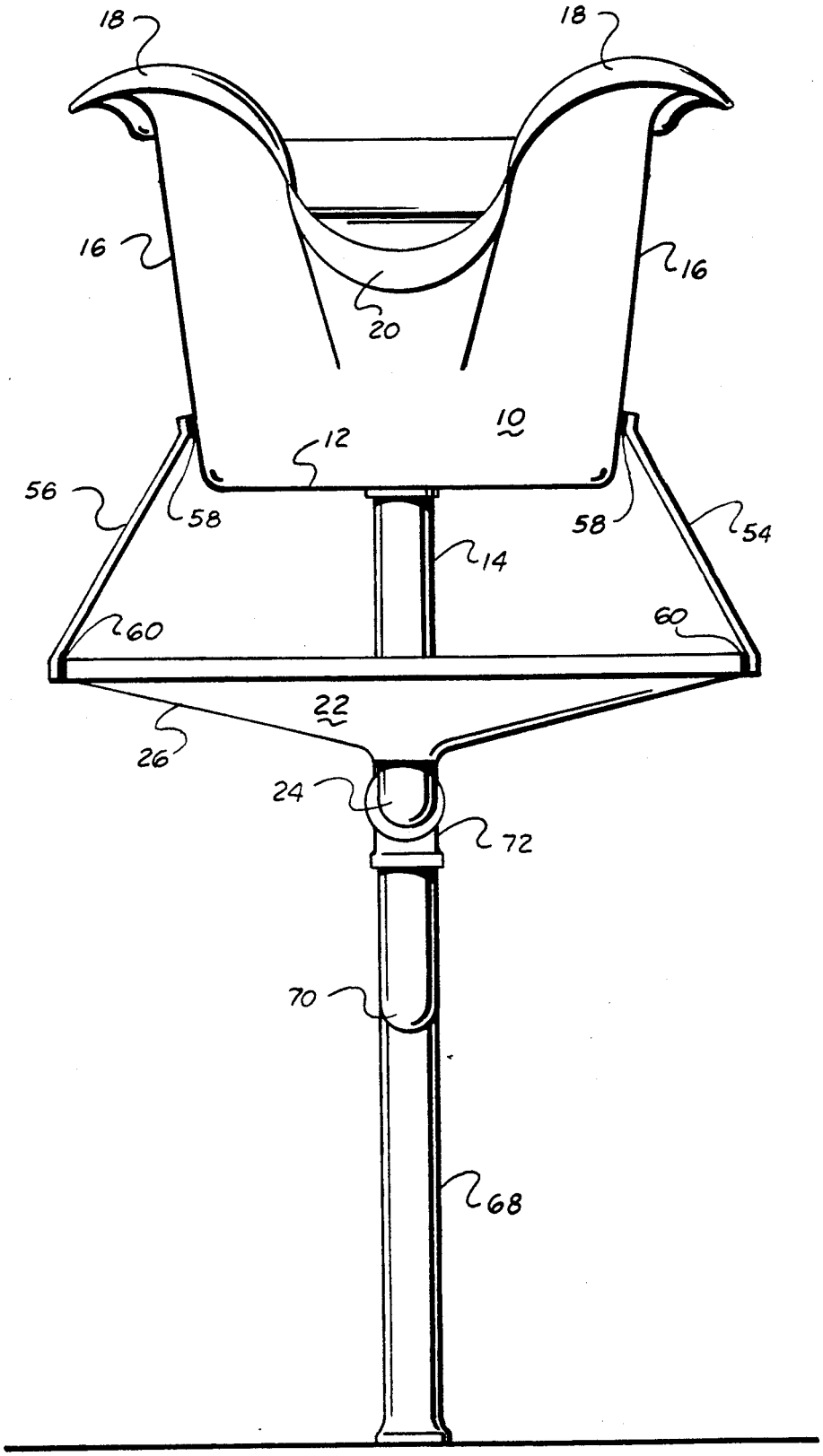
FIG. 2 is a front view assembly of the combined basin 10 and the drip pan 22.
Figure 3:
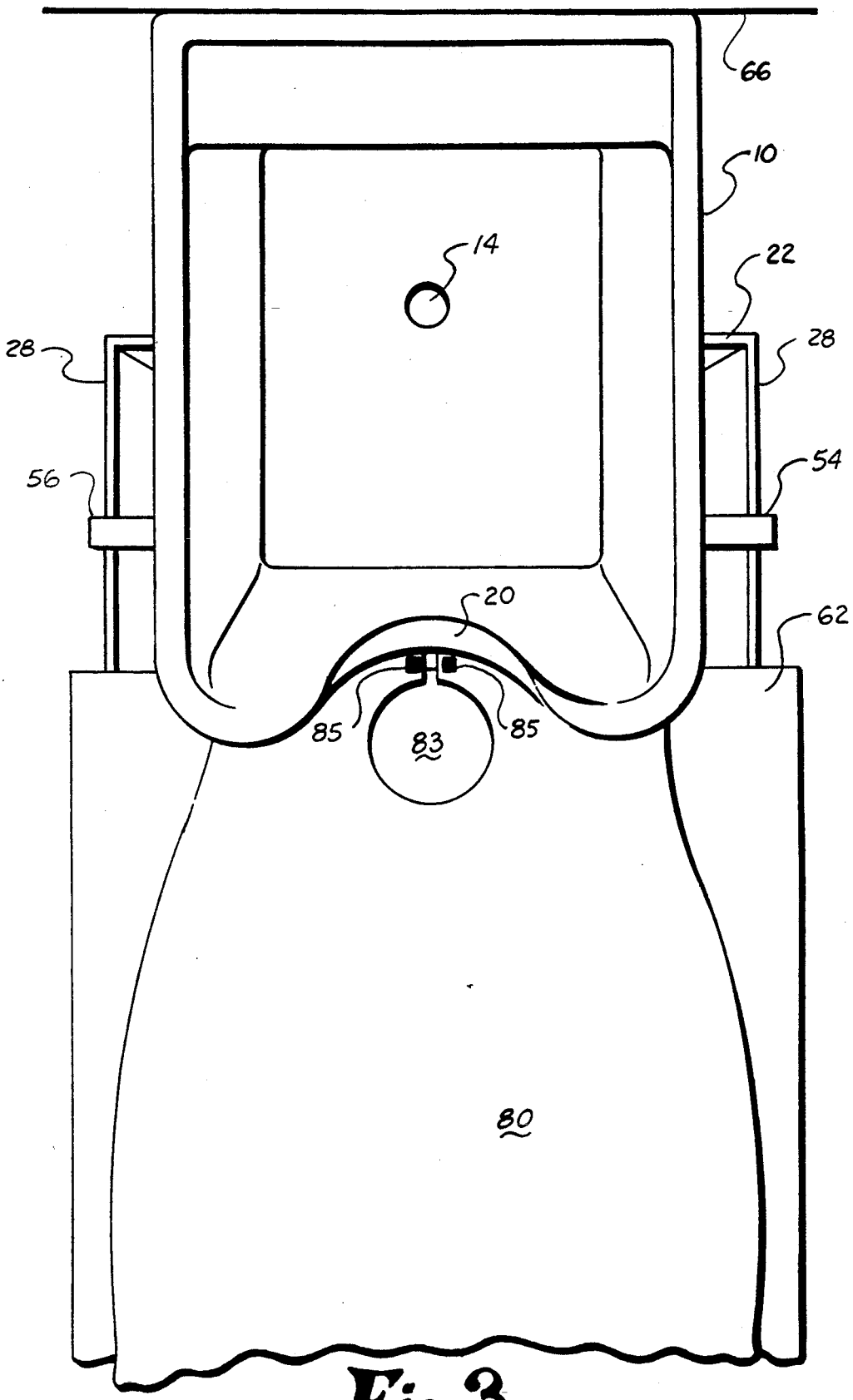
FIG. 3 is a plan view of the combined basin 10, shampoo cape (80), chair (62), and the drip pan 22 in an assembled condition.

What is shown in FIG. 2 is a front view of a drip pan assembly according to the present invention. The drip pan 22 is preferably formed of fiberglass or plastic. The drip pan 22 has a drain line 24 that extends downwardly through a pan portion 26 of the drip pan 22. Preferably the pan portion is formed of fiber-glass or plastic in a substantially planar configuration. The pan portion 26 has side wall means 28 extending upwardly therefrom, and the side wall means 28 and the pan portion the pan 26 co-operate so as to direct any material falling in the pan assembly to the drain 24 (as shown in FIG. 1). The pan portion 26 is intended to refer to the bottom sections of the drip pan 22. The pan portion may also be made of a single planar portion that extends across the bottom of the drip pan assembly and is formed of a fiberglass or plastic material As can be seen in FIG. 3, the drip pan 22 is preferably rectangular when viewed in plan. By comparing the view of the drip pan 22 with the view given for the basin, it can be seen that the preferred mode of this invention will have the drip pan 22 with portions that project outwardly from the surrounding walls of the basin, when positioned correctly below the basin.

What is shown in FIG. 3 is the plan view assembly according to the present invention. As can be seen clearly in FIG. 3, drip pan 22 is located beneath the upper rim 18 of the basin 10. Further, the drip pan 22 is located beneath the basin 10 so that its pan portion 26 is shown extending from side wall means 28 to the other side wall means 28, beneath basin 10. The drip pan 22 is shown having peripheral boundaries at 40, 42, and 44, that extended beyond the outer peripheral boundaries of the basin 10 on at least portions of two side walls and the front of basin 10. In this manner then, the hair treatment material that falls outside the outer peripheral boundary 46 of the basin 10 will fall into the drip collection tray. If one wishes the drip tray may completely surround the outer periphery of the basin 10, however very little problem of containing hair treatment materials is encountered at the rear 50 of the basin 10 where the sink or drain joins a wall. It is at the front 52 of the basin 10 that the contoured head/neck rest 20 is formed and that presents the problems.

Shown in FIG. 2 is the drip tray 22 that is supported by brackets 54 and 56. Brackets 54 and 56 are shown connecting to, and extending between the lateral walls 16 of the base portion 12 and the side wall means 28 of the pan portion 26. The connections shown at 58 and 60 may be by threaded fasteners with rubber sealing grommets or by suction cups.

What is shown in FIG. 1 is a chair 62 having an upright and adjustable back portion 64 for a patron to be seated on during a hair treatment operation. The basin 10 is shown appropriately fastened to the wall at 66. (For reference purposes, the back of the chair is facing what is herein termed the front of the basin 10 and the front of the drip tray 22.) A drain line 68 is shown with a trap assembly at 70. The drain line 14 of the basin 10 and the drain line 24 of the drip tray 22 are shown joined together by the pipe joint 72. As can be seen the upright back portion 64 of the chair 62 has guide post means 74 extending upwardly therefrom. A shampoo cape assembly 80 is shown extending between the guide post means 74 and positioned to direct any hair treatment material (falling downwardly from the rim 18 of the basin 10) to the drip tray 22, over front of basin (10) from overhanging top part of shampoo cape (80).

Shown in FIG. 3 is a shampoo cape assembly 80, which is preferably formed of a plastic or other waterproof or water repellant material. The shampoo cape 80 has a front part that is designed to substantially cover the front of the patron with the neck of the patron fitting through opening aperture 83 with co-operating fasteners 85 and providing a closure means of the shampoo cape assembly around the patron's neck. The fasteners used may be co-operating patches of velcro or the usual "lock" type fasteners known in the industry. The portions 86 and 88 of the shampoo cape may then be designed so as to extend over the back of the chair and downwardly toward the sink assembly 22. Slit 87 is provided from the opening 83 of the shampoo cape 80 to one of the distal ends of the shampoo cape 80.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

I claim:

1. A hair treatment sink assembly which comprises:

a. a base portion;

b. lateral walls completely surrounding said base portion and extending upwardly therefrom, said lateral walls comprised of a front wall, rear wall, and two side walls;

c. an upper peripheral rim formed by the termination of said upwardly extending lateral walls;

d. a head and neck rest formed in said upper peripheral rim and located in said front wall;

e. a first drain line connected to and extending downwardly from said base portion to drain said base portion;

f. a drip collection tray attached to said lateral walls and located below said upper peripheral rim, said drip collection tray having an outer peripheral boundary extending outwardly from portions of said lateral walls such that said head and neck rest overlie said tray within said boundary to collect material falling from said rim outside of said lateral walls; and g. a second drain line extending downwardly from said drip collection tray and connected to said first drain line to drain the collected material.

2. The hair treatment sink assembly according to claim 1 in which said drip collection tray comprises:

a. a synthetic resin basin extending downwardly having a drain hole; and extending downwardly b. side wall means extending upwardly from the pan portion and completely surrounding the basin, said side wall means and said basin having co-operating means thereon to direct falling hair treatment material to said drip pan drain.

3. The hair treatment sink according to claim 1 which further comprises:

a drain joint joining said first drain line to said second drain line.

4. The hair treatment sink assembly according to claim 2 wherein:

said drip collection tray has a rectangular configuration when viewed in plan.

5. The hair treatment sink assembly according to claim 4 wherein:

said rectangular configuration has approximate dimensions of 18½ inches by 13½ inches.

6. The hair treatment sink assembly according to claim 5 wherein:

said side wall means of said basin are 4 inches in height.

7. The method of collecting hair treatment materials during a hair treatment operation which comprises the steps of:

a. forming a head and neck rest in an upper peripheral rim of a basin;

b. surrounding the head and neck rest of said basin, when viewed from a plan view, with a drip tray, and locating the drip tray beneath a lowermost portion of said basin;

c. resting a person's head and neck on said head and neck rest so that the head is over the basin;

d. applying hair treatment materials to the head of the person and allowing the excess materials to fall into the basin;

e. collecting any materials that fall outside said basin in said drip tray; and f. draining said basin and said drip tray into a common drain outlet.

8. The method according to claim 7 which further includes the steps of:

a. locating an upright back portion chair next to the basin so that a person may be seated and rest the head and neck on the head and neck rest of the basin; and b. extending a shampoo cape between posts 13½ inches apart on upper back side of the chair and over front side of said drip tray so that material falling on shampoo cape is directed to said drip tray.

9. The method according to claim 8 which further includes the step of:

providing shampoo cape guide means on each lateral side of the two posts 13½ inches apart and placing said shampoo cape between said guide means.

10. The method according to claim 9 which further includes the steps of:

a. forming the drip tray of synthetic resin;

b. providing a drain hole extending down through said tray; and c. providing the tray with surrounding side wall means that extend upwardly from the tray so that the tray and the side wall means direct material falling on the tray to the drain.

* * * * *